US007731178B2

(12) United States Patent
Miyake et al.

(10) Patent No.: US 7,731,178 B2
(45) Date of Patent: Jun. 8, 2010

(54) FEEDING DEVICE

(75) Inventors: Toshio Miyake, Nagano (JP); Atsuhiko Takeuchi, Nagano (JP); Yuji Miyamoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 60 days.

(21) Appl. No.: 11/486,191

(22) Filed: Jul. 12, 2006

(65) Prior Publication Data

US 2007/0019055 A1 Jan. 25, 2007

(30) Foreign Application Priority Data

Jul. 12, 2005 (JP) ..... P2005-202441

(51) Int. Cl.
*B65H 3/52* (2006.01)

(52) U.S. Cl. ..... 271/121; 271/122; 271/124; 271/125

(58) Field of Classification Search ..... 271/121, 271/124, 125, 122
See application file for complete search history.

(56) References Cited

U.S. PATENT DOCUMENTS 6,199,855 B1 * 3/2001 Choeng et al. ..... 271/122
6,824,132 B2 * 11/2004 Asai et al. ..... 271/125
6,877,738 B2 * 4/2005 Sonoda et al. ..... 271/121
7,111,934 B2 * 9/2006 Okuda et al. ..... 347/104
7,422,206 B2 * 9/2008 Okuda et al. ..... 271/121

FOREIGN PATENT DOCUMENTS

| | | |
|---|---|---|
| JP | 09-272642 | 10/1997 |
| JP | 2000-247513 | 9/2000 |
| JP | 2002-128320 | 5/2002 |
| JP | 2005-112496 | 4/2005 |

* cited by examiner

*Primary Examiner*—Patrick Mackey
*Assistant Examiner*—Luis Gonzalez
(74) *Attorney, Agent, or Firm*—Nutter McClennen & Fish LLP; John J. Penny, Jr.

(57) ABSTRACT

A feeding device includes: a hopper, adapted to support a medium; a feeder, operable to feed the medium in a first direction; a separator, operable to nip the medium with the feeder at a nip point; and a guide, having a guide surface which guides the medium in the first direction and is provided with a recessed portion at a downstream side of the nip point in the first direction.

10 Claims, 8 Drawing Sheets

FEEDING DEVICE

BACKGROUND OF THE INVENTION

The present invention relates to a feeding device which feeds a recording medium in a facsimile machine, a printer or the like, and to a recording apparatus equipped with the feeding device. Also, the invention relates to a liquid jet apparatus.

As used herein, the liquid jet apparatus implies not only a recording apparatus, such as a printer, a copier and a facsimile machine, which uses an inkjet recording head and carries out a recording on a recording medium by ejecting ink from the recording head, but also an apparatus which jets a liquid, in place of ink, which corresponds to the use of the ink, onto a jetting medium, which corresponds to the recording medium, from a liquid jet head, which corresponds to the inkjet recording head, thereby causing the liquid to adhere to the jetting medium.

The liquid jet head includes, in addition to the recording head, a color material jet head for use in manufacturing a color filter for a liquid crystal display or the like, an electrode material (electrically conductive paste) jet head for use in forming an electrode for an organic light emitting display, a surface emitting display (FED) or the like, a living organic material jet head for use in manufacturing biochips, a sample jet head as a precision pipette, and the like.

As an example of the recording apparatus or the liquid jet apparatus, there is an inkjet printer, and some inkjet printers are equipped with a feeding device (a so-called auto sheet feeder) on which a plurality of sheets of printing paper, acting as the recording medium or the jetting medium, is set in an inclined position. The feeding device includes a feeding roller which feeds the printing paper, a hopper which supports the printing paper in the inclined position, and a separating member which, being provided facing the feeding roller, separates one sheet of printing paper from another (prevents a multiple feeding).

At this point, as an example of the separating member, a separating roller such as is shown in JP-A-2005-112496 is used. The separating roller to which a prescribed rotational resistance (torque) applied is driven to rotate with respect to the feeding roller in a case in which a torque equal to or higher than the prescribed torque is applied to the separating roller, more specifically, in a case in which no printing paper or only one sheet of printing paper exists between the feeding roller and the separating roller. However, the separating roller is not driven to rotate with respect to the feeding roller in a case in which a torque equal to or lower than the prescribed torque is applied to the separating roller, more specifically, in a case in which two or more sheets of printing paper exist between the feeding roller and the separating roller. By this means, the leading edge of the next or subsequent sheet of printing paper, which is about to be multiply fed along with an uppermost sheet to be fed, stays at the separating roller, thereby preventing a multiple feeding of printing paper.

Although the related feeding device is configured in such a way that a multiple feeding of printing paper is prevented by such separating member as described heretofore, in a case of a strong adhesion between the sheets or a like case, the next or subsequent sheet of printing paper may advance downstream of a nip point between the feeding roller and the separating member, that is, may be multiply fed along with the uppermost sheet.

SUMMARY

It is therefore an object of the invention to provide a feeding device which can more reliably prevent a multiple feeding of printing paper. More specifically, the object of the invention is to provide a feeding device which, even in the event that the next or subsequent sheet of printing paper has advanced downstream of a nip point between a feeding roller and a separating member, can prevent the next or subsequent sheet of printing paper from advancing further downstream.

In order to achieve the object, according to the invention, there is provided a feeding device comprising:

a hopper, adapted to support a medium;

a feeder, operable to feed the medium in a first direction;

a separator, operable to nip the medium with the feeder at a nip point; and a guide, having a guide surface which guides the medium in the first direction and is provided with a recessed portion at a downstream side of the nip point in the first direction.

With this configuration, on the guide surface which, being provided in a position facing the feeder, guides the medium to the downstream side, the recessed portion is formed in a portion thereof downstream of the nip point between the feeder and the separator. Therefore, in the event that, along with an uppermost medium to be fed, the next or subsequent medium advances downstream of the nip point, the leading end of the next or subsequent recording medium is led into the recessed portion.

The feeding device further include a lever, operable to pivot in a pivoting area that includes a point corresponding to the nip point in a second direction perpendicular to the first direction; and a controller, operable to control the lever so that an end portion of the lever is positioned so as to correspond to the recessed portion in the second direction after a leading end of the medium has passed through the nip point.

The medium may include a first medium and a second medium that is to be fed next to the first medium, and the end portion of the lever may be positioned so as to correspond to the recessed portion in the second direction after a leading end of the first medium has passed through the nip point so that the lever prevents the second medium from being fed.

In this case, the leading end of the next or subsequent medium can be stopped from advancing downstream by the end portion of the lever.

By this means, even in the event that the next or subsequent medium has advanced downstream of the nip point, as it is prevented from advancing further downstream, it is possible to more reliably prevent a multiple feeding of media.

In a case the end portion of the lever is positioned so as to correspond to the recessed portion in the second direction, an angle between the leading end of the medium and the lever may be a substantially right angle.

In this case, when the leading end of the next or subsequent medium, which is about to be multiply fed along with the uppermost medium, abuts against the lever, such a leading end can be prevented from advancing downstream. The "substantial right angle", being a design matter which those skilled in the art can determine as appropriate, refers to an angle of abutment of the medium leading end against the lever which, in order for the medium leading end to be reliably stopped by the lever, does not need to be set exactly at a right angle, and which, even with some error, when the medium leading end has abutted against the lever, prevents such a leading end from easily coming off the lever and advancing downstream.

The guide surface may include top surfaces of a plurality of ribs which are arranged in the second direction with a prescribed interval, and at least one of the ribs which is adjacent to the lever may be provided with the recessed portion.

In this case, at a position close to the recessed portion, an advance of the medium leading end can be stopped by the lever. Consequently, it is possible to more reliably prevent an advance of the leading end of the next or subsequent medium which is about to be multiply fed along with the uppermost medium.

The recessed portion may include a wall portion substantially perpendicular to the first direction.

In this case, even in the event that, along with the uppermost medium to be fed, the next or subsequent medium advances downstream of the nip point, its leading end is caught by the recessed portion including the wall portion and stopped from advancing downstream. By this means, even in the event that the next or subsequent medium has advanced downstream of the nip point, as it can be stopped from advancing further downstream, it is possible to more reliably prevent a multiple feeding of media.

As the uppermost medium to be fed undergoes a strong feeding force caused by the feeder, even though its leading end is caught by the recessed portion, it can cross over the recessed portion and advance downstream. However, as the next or subsequent medium does not undergo the strong feeding force caused by the feeder, when its leading end is caught by the recessed portion, it is stopped by the recessed portion from advancing further downstream.

The separator may include a roller which is urged toward the feeder and to which a prescribed rotational resistance is applied.

In this case, in order to prevent a non-feeding while preventing a multiple feeding of media, it is necessary to adjust an urging force, by which the separator is urged toward the feeder, and the rotational resistance to an appropriate range. Even in the event that the next or subsequent medium has advanced downstream of the nip point, it can be stopped from advancing further downstream. Therefore, even in the event that the urging force and the rotational resistance fall outside the appropriate range, it is possible to prevent a multiple feeding of media.

According to the invention, there is provided a recording apparatus incorporating the above feeding device, comprising:

a recording device, disposed in the downstream section and operable to record information on the medium fed by the feeding device.

According to the invention, there is provided a liquid ejecting apparatus incorporating the above feeding device, comprising:

a liquid ejecting device, disposed in the downstream section and operable to eject liquid toward the medium fed by the feeding device.

DETAIL DESCRIPTION OF PREFERRED EMBODIMENTS

An embodiment of the invention will hereafter be described with reference to the drawings.

1. Overall Configuration of Printer

Figure 1:
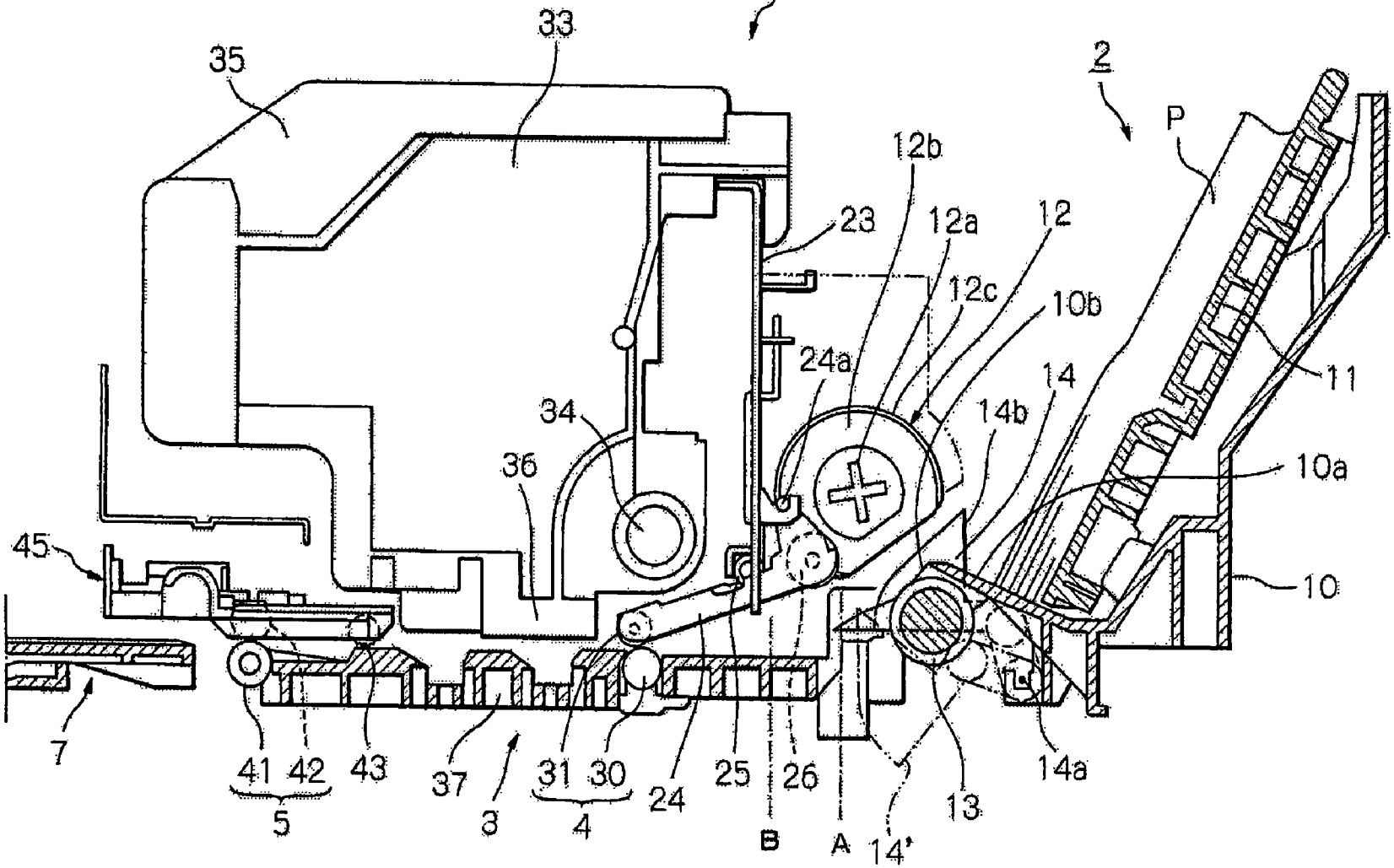
FIG. 1 is a sectional side view of a printer according to the invention.

Hereafter, first, a description will be given, while referring to FIG. 1, of a configuration of an inkjet printer (hereafter called a "printer") 1, which is an example of the recording apparatus or the liquid jet apparatus according to the invention, and a configuration of a recording medium feeding device (hereafter called a "feeding device") 2. At this point, FIG. 1 is a sectional side view of the printer 1. Hereafter, a left hand side (a printer front) in FIG. 1 is referred to as a "downstream side" of a paper transport path, and a right hand side (a printer rear) as an "upstream side".

The printer 1 is equipped at the rear with the feeding device 2 in which recording paper (mainly single sheets, hereafter called "paper P"), which is an example of the "recording medium" or the "jetting medium", can be set in an inclined position. The paper P is fed from the feeding device 2 toward downstream a recording medium transport device 4. The fed paper P is transported to downstream a recording device 3 by the recording medium transport device 4, and a recording is executed. Then, the paper P recorded by the recording device 3 is discharged to the apparatus front by downstream recording medium discharge device 5.

In the printer 1, a tray (not shown), on which an optical disc (not shown) can be set, is configured to be transportable by the recording medium transport device 4, and a direct recording on a label side of the optical disc set on the tray can be executed by the recording device 3. Reference numeral 7 in FIG. 1 depicts a tray guide which supports the tray. The tray is inserted via the tray guide 7 from the front toward the rear of the printer 1, and transported in a sub-scanning direction by the recording medium transport device 4.

Hereafter, a more detailed description will be given of components in the paper transport path of the printer 1. The feeding device 2 feeds the paper P, which is stacked and supported in the inclined position, one uppermost sheet at a time, toward the recording medium transport device 4 as a feeding roller 12 rotates. A configuration of the feeding device 2 will be described in detail hereafter.

A paper detector (not shown), which detects a passage of the paper P, and a guide roller 26, which reduces a transport load by causing the paper P to form a feeding position and preventing the paper P from being brought in contact with the feeding roller 12, are provided between the feeding device 2 and the recording medium transport device 4. In this embodiment, the guide roller 26 is rotatably supported at an upstream end of a paper guide above 24.

The recording medium transport device 4 provided downstream of the feeding device 2 includes a transport driving roller 30, which is rotationally driven by a not-shown motor, and a transport follower roller 31, which is driven to rotate in pressure contact with the transport driving roller 30. The transport follower roller 31 is rotatably supported at a downstream end of the paper guide above 24. The paper guide above 24, by having a shaft 24*a* pivoted to a main frame 23, is provided so as to be pivotable about the shaft 24*a* as seen from a side of the paper transport path, and is urged by a coil spring 25 in a direction in which the transport follower roller 31 comes into pressure contact with the transport driving roller 30.

The paper P, which has reached the recording medium transport device 4, is transported to the downstream recording device 3 as the transport driving roller 30 rotates with the paper P nipped between it and the transport follower roller 31.

The recording device 3 includes an inkjet recording head (hereafter called a "recording head") 36 and a paper guide below 37 provided facing the recording head 36. The recording head 36, being provided at a bottom of the carriage 33, is driven by the not-shown drive motor so as to reciprocate in a main scanning direction while being guided by a carriage guide shaft 34 extending in the main scanning direction. Also, the carriage 33, mounting independent ink cartridges 35 for each of a plurality of colors, supplies ink to the recording head 36.

The paper guide below 37, which regulates a distance between the paper P and the recording head 36, as well as having a rib formed on a surface thereof facing the recording head 36, is formed with a recess into which ink is discarded, and a printing without any margin, that is a so-called marginless printing, is carried out, in an edge portion of the paper P by discarding the ink ejected onto an area outside the edge of the paper P into the recess.

Subsequently, a guide roller 43 and the recording medium discharge device 5 are provided downstream of the recording head 36. The guide roller 43 carries out a function of preventing the paper P from hovering off the paper guide below 37 to maintain a constant distance between the paper P and the recording head 36. The recording medium discharge device 5 includes a discharge driving roller 41, which is rotationally driven by the not-shown drive motor, and a discharge follower roller 42, which is driven to rotate in contact with the discharge driving roller 41.

In this embodiment, the discharge driving roller 41 is made up of a rubber roller, a plurality of which is provided in an axial direction of a shaft body which is rotationally driven. Also, a plurality of the discharge follower rollers 42, each being made up of a spur roller having a plurality of teeth on the outer periphery, is provided on a paper discharge frame assembly 45, which has a shape elongated in the main scanning direction, so as to correspond to the plurality of discharge driving rollers 41.

The paper P recorded by the recording device 3 is discharged toward the apparatus front (a not-shown stacker) as the discharge driving roller 41 is rotationally driven with the paper nipped between it and the discharge follower roller 42.

The paper discharge frame assembly 45 is provided so as to be displaceable by not-shown release device in such a way that it can take a contact position, in which the discharge follower roller 42 is in contact with the discharge driving roller 41, and an out-of-contact position, in which the discharge follower roller 42 is out of contact with the discharge driving roller 41.

2. Configuration of Feeding Device 2

Figure 2:
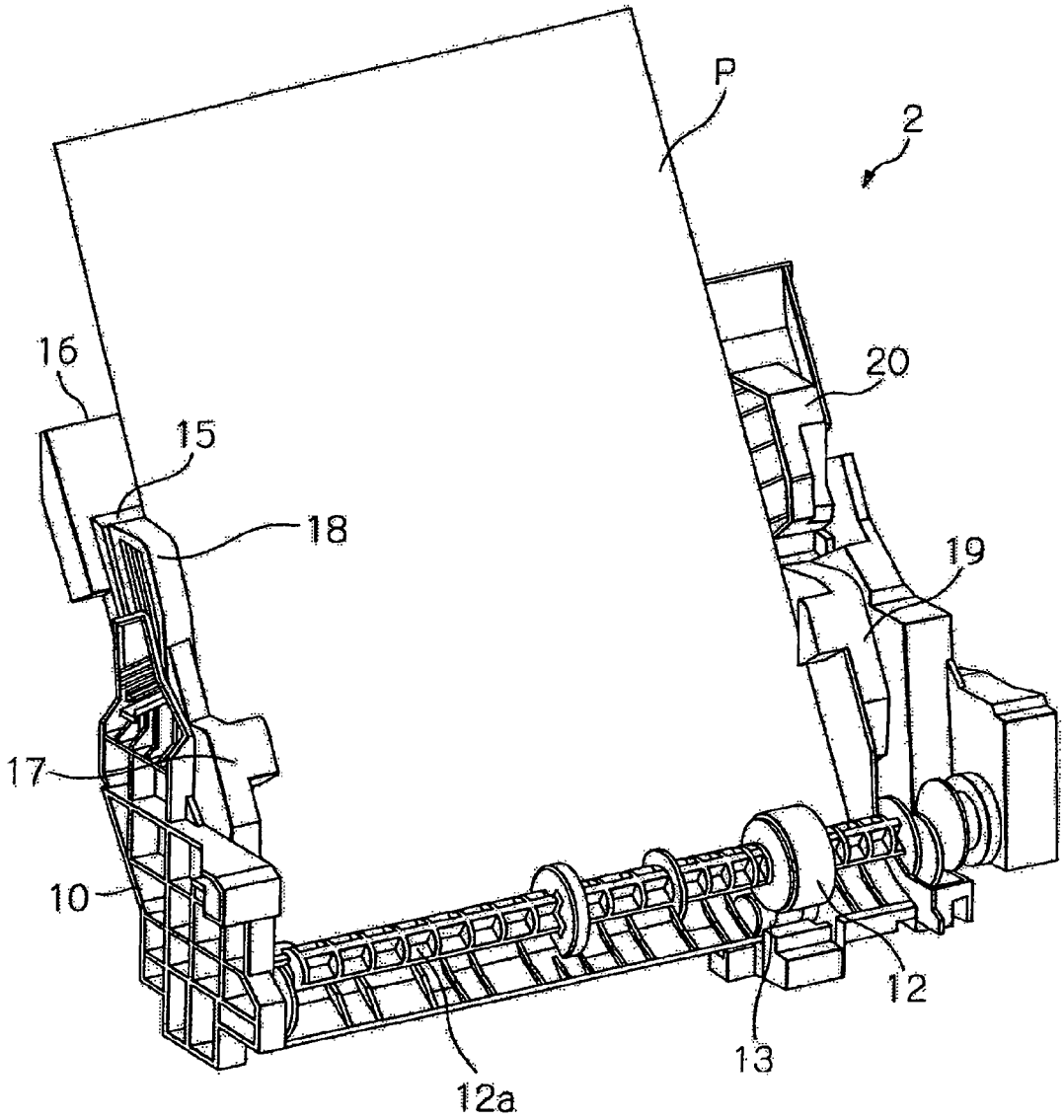
FIG. 2 is a perspective view of an exterior of a feeding device according to the invention.
Figure 4:
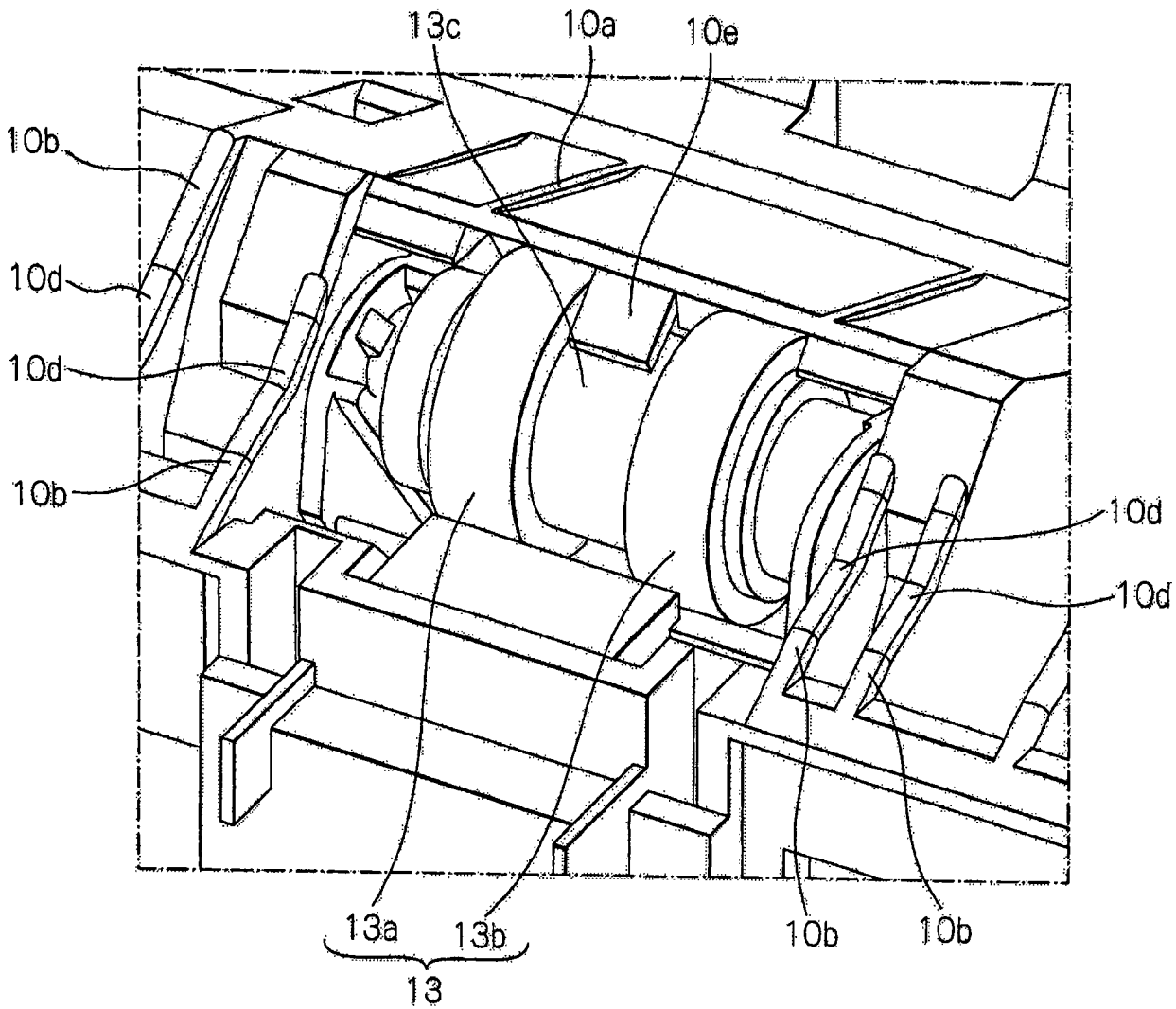
FIG. 4 is a perspective view of an exterior of a retard roller and its periphery.
Figure 5:
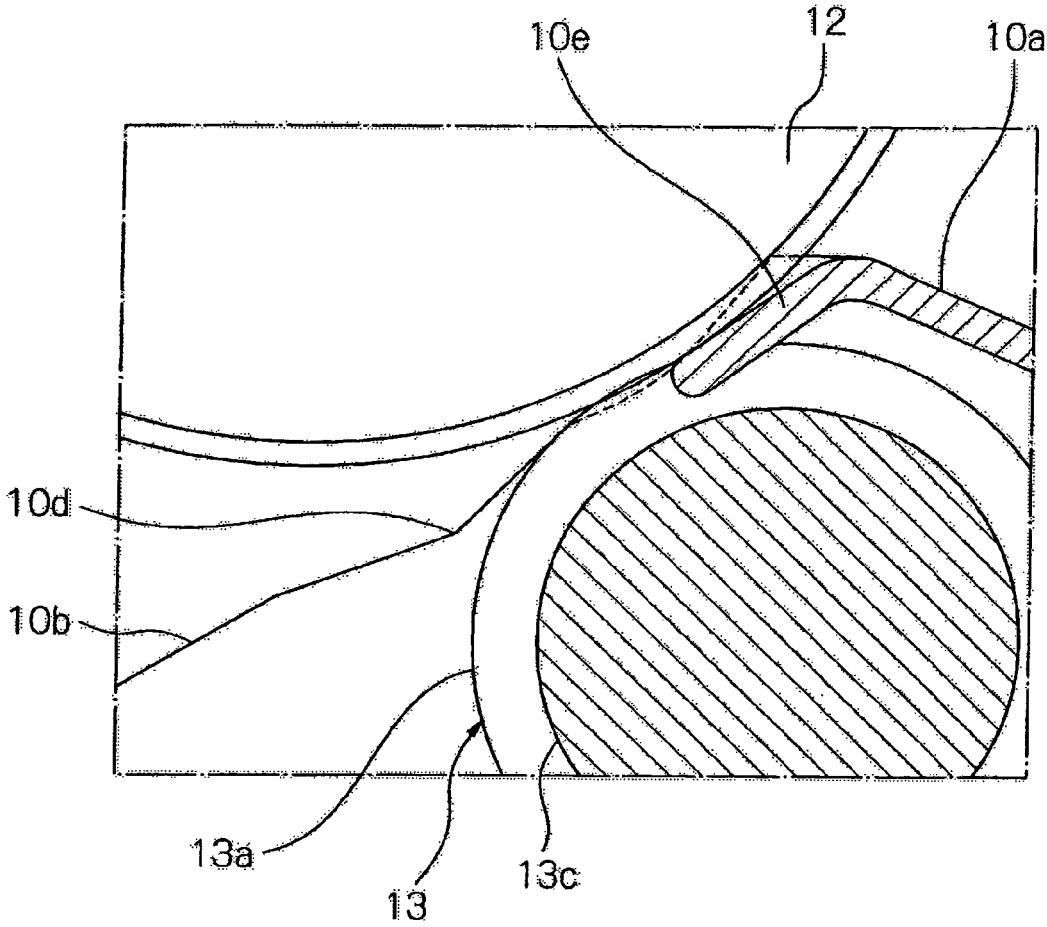
FIG. 5 is a sectional side view of the retard roller and its periphery.
Figure 6:
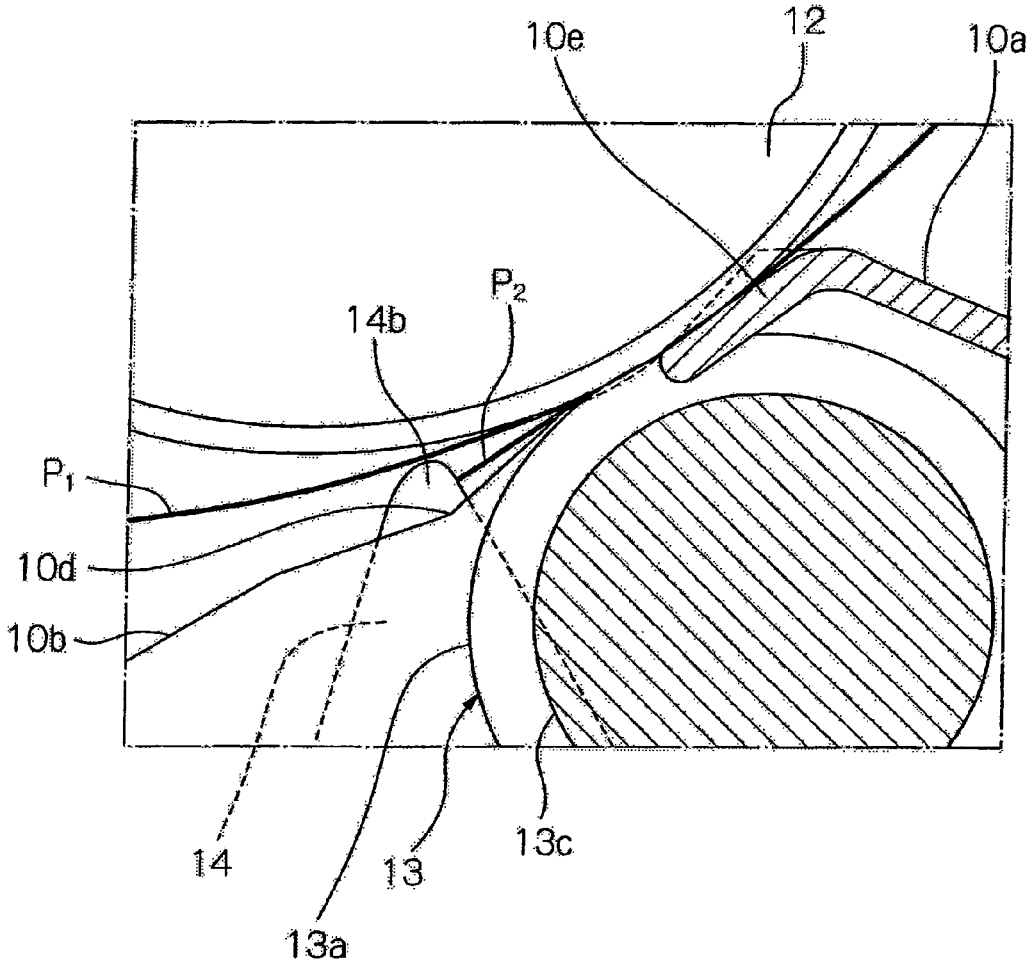
FIG. 6 is a sectional side view of the retard roller and its periphery.
Figure 7:
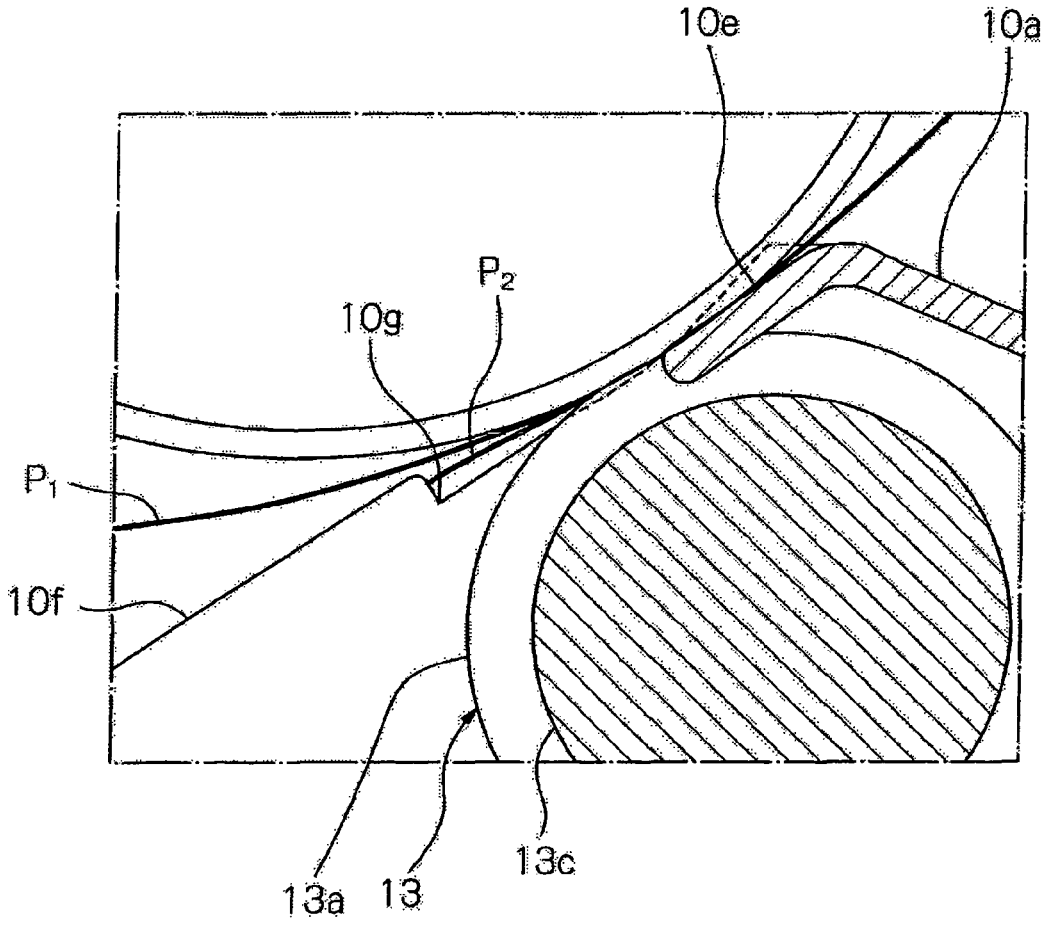
FIG. 7 is a sectional side view of the retard roller and its periphery.
Figure 8:
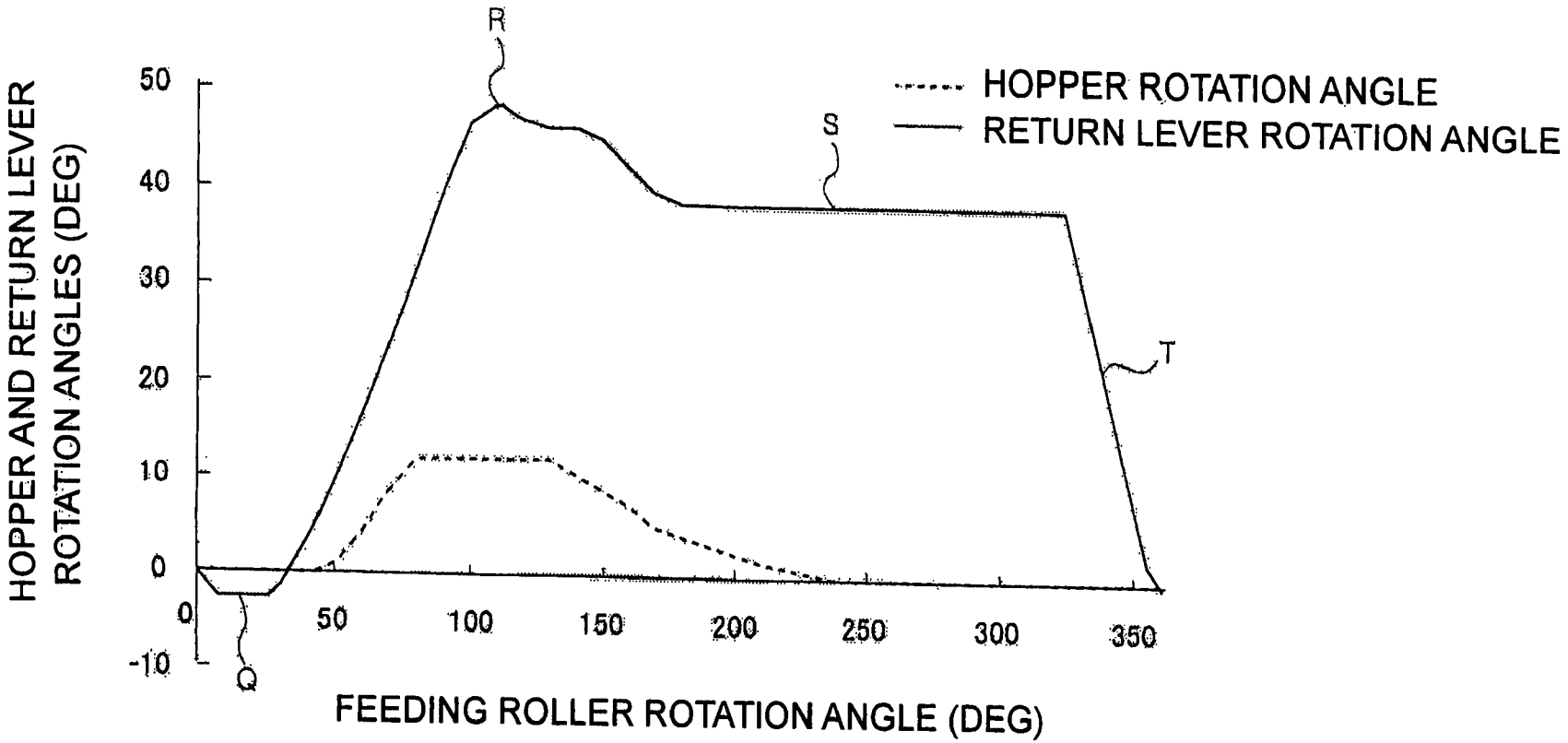
FIG. 8 is a chart showing an operation timing of components of the feeding device.

Subsequently, a detailed description will be given, while referring to FIGS. 1 to 7, of a configuration of the feeding device 2. FIG. 2 is a perspective view of an exterior of the feeding device 2, FIG. 3 is a perspective view of a main portion thereof, FIG. 4 is a perspective view of an exterior of a retard roller 13 and its periphery, FIGS. 5 to 7 are sectional side views thereof, and FIG. 8 is a chart showing an operation timing (rotation angle) of a hopper 11 and a return lever 14 with respect to each phase (rotation angle) of the feeding roller 12.

Figure 3:
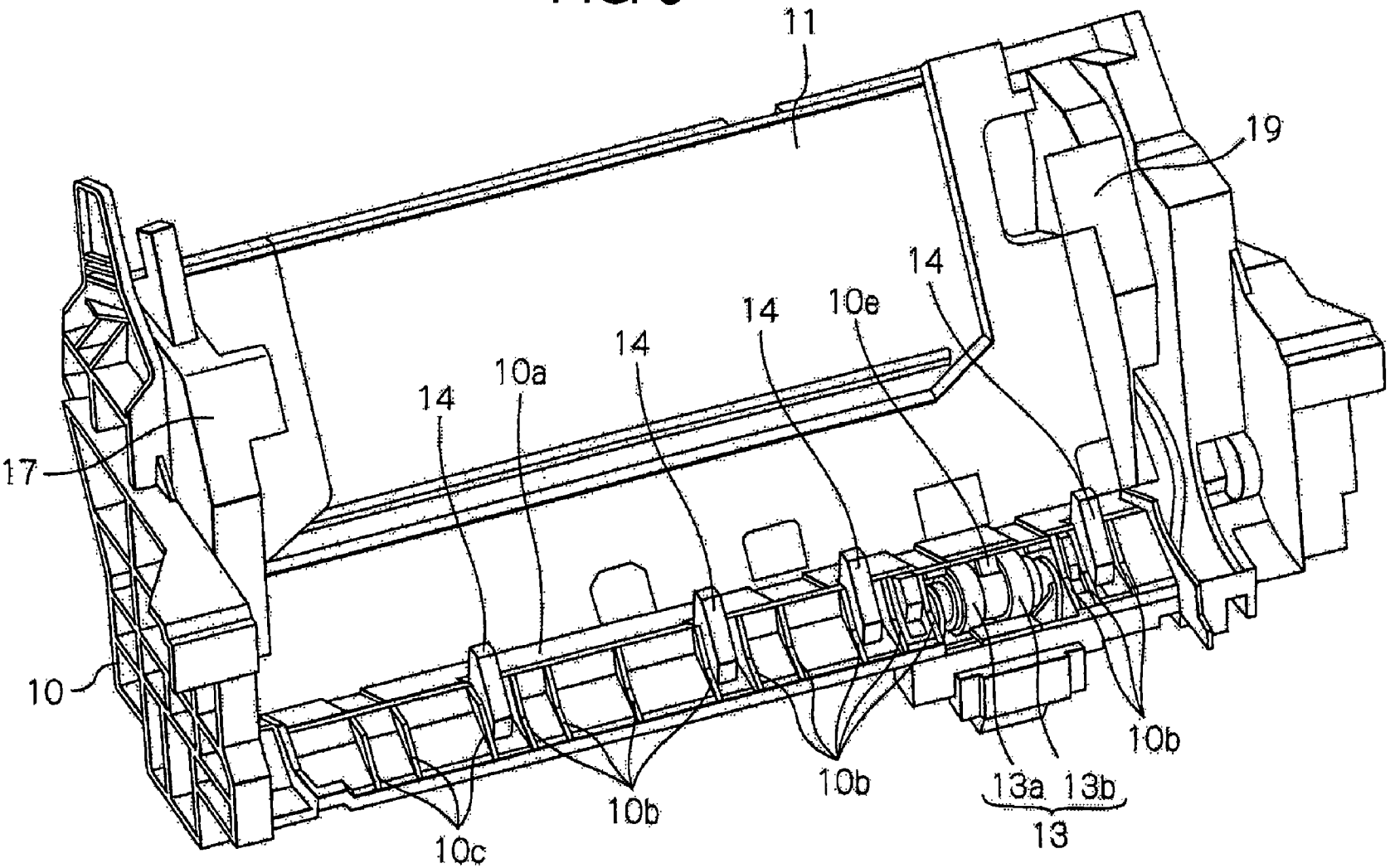
FIG. 3 is a perspective view of a portion of the feeding device according to the invention.

As shown in FIGS. 1 to 3, the feeding device 2 includes the hopper 11, the feeding roller 12, the retard roller 13, and the recording medium return lever (hereafter called the "return lever") 14.

The feeding device 2 is substantially configured by attaching the components to a frame 10 as shown in FIGS. 2 and 3. The frame 10, being formed in a substantial L shape seen from a side as shown in FIG. 1, has a leading edge support surface 10*a*, which supports the leading edge of the paper P supported in the inclined position by the hopper 11, in a position facing the hopper 11, and guide surfaces 10*b* (and 10*c* in FIG. 3), which guide the paper P downstream, in a position facing the feeding roller 12.

Consequently, the leading edge of the paper P set on the feeding device 2 comes into sliding contact with the leading edge support surface 10*a* in conjunction with a pivotal motion of the hopper 11, then passes through a portion in which the leading edge support surface 10*a* and the guide surfaces 10*b* (and 10*c*) meet, and advances downstream while being guided by the guide surfaces 10*b* (and 10*c*). As described heretofore, the frame 10, as well as constituting a fundamental body of the feeding device 2, which guides the paper P during a feeding.

Returning to FIG. 1, the hopper 11, being made up of a plate-shaped body, is configured to be pivotable about a pivotal point (not shown) at an upper portion, in which it pivots and thereby switches between a pressure contact position, in which the paper P supported in the inclined position on the hopper 11 is brought into pressure contact with the feeding roller 12, and an out-of-contact position, in which the paper P is taken out of contact with the feeding roller 12.

The feeding roller 12, including a high friction layer (for example, rubber) 12*c* on the outer periphery of a roller body 12*b* formed in a substantial D shape seen from a side, is selectively rotationally driven about a rotary shaft 12*a* by the not-shown motor only during a paper feeding. The feeding roller 12 is controlled in such a way that it feeds an uppermost sheet of paper P, which is pressed by its circular arc portion, to the downstream side, while, as shown in the figure, its flat portion faces the paper P so as not to cause a transport load during a transport of the paper P by the recording medium transport device 4 after the paper P has been fed.

The retard roller 13, including a high friction layer on its outer periphery as in the feeding roller 12, is provided in a position facing the feeding roller 12 in such a way that it can make pressure contact with the feeding roller 12 and in a condition in which a prescribed rotational resistance (torque) is applied to it. In a case in which only one sheet of paper P is being fed without causing any multiple feeding of the paper P, the retard roller 13 is driven to rotate (in a counterclockwise direction in FIG. 1) in contact with the one sheet of paper P. In a case in which a plurality of sheets of paper P exists between the feeding roller 12 and the retard roller 13, as a friction coefficient between the sheets is lower than a friction coefficient between the paper P and the retard roller 13, the retard roller 13 does not rotate but is placed in a stopped condition. Consequently, by this means, the leading edge of the next or subsequent sheet of paper P, which is about to be multiply fed along with the uppermost sheet of paper P to be fed, stays at a nip point between the retard roller 13 and the feeding roller 12, thus preventing a multiple feeding.

Meanwhile, a leading edge guide surface 10*e*, which extends from an end portion of the leading edge support surface 10*a* closer to the feeding roller 12 toward the nip point between the feeding roller 12 and the retard roller 13 as seen from a side a paper P feeding path, is provided in a position in which the feeding roller 12 is disposed, extending in a paper width direction (a direction perpendicular to a paper feeding direction), as shown in FIGS. 3 and 4.

Hereafter, a detailed description will be given of the leading edge guide surface 10*e*. In FIG. 4, the retard roller 13 includes two rollers 13*a* and 13*b* which are spaced apart in a direction of its rotation axis. In other words, the retard roller 13 is divided into two in the direction of its rotation axis, in which the divided rollers 13*a* and 13*b* are each provided so as to be able to make pressure contact with one feeding roller 12. To further rephrase, the retard roller 13 includes large diameter portions 13*a* and 13*b*, which can make pressure contact with the feeding roller 12, and a small diameter portion 13*c*, which can form a gap with respect to the outer periphery of the feeding roller 12. To rephrase still further, a groove 13*c* having a small diameter is formed on the outer periphery of the retard roller 13.

As shown in FIG. 5, the leading edge guide surface 10*e*, being disposed in such a way as to enter the small diameter portion (groove) 13*c*, carries out a function of guiding the leading edge of the paper P being fed, to the nip point between the feeding roller 12 and the retard roller 13.

At this point, when the paper P leading edge abuts at a steep angle against the retard roller 13, there is a likelihood that the leading edge of the paper P stops in a condition in which it abuts against the retard roller 13, that is, a likelihood that a non-feeding occurs. Also, although the retard roller 13 is provided urged toward the feeding roller 12, the paper leading edge abuts at a steep angle against the retard roller 13, whereby the paper leading edge depresses the retard roller 13, and the retard roller 13 may thereby be separated from the feeding roller 12. In this case, as-the retard roller 13 cannot be driven to rotate with respect to the feeding roller 12, the uppermost sheet of paper P to be fed cannot advance downstream while it remains abutting against the retard roller 13, thus resulting in a non-feeding.

However, as the leading edge of the paper P being fed as described heretofore is guided by the leading edge guide surface 10*e* to the nip point between the feeding roller 12 and the retard roller 13, it is prevented from abutting at a steep angle against the retard roller 13. As a result, it is possible to prevent a non-feeding caused by the paper leading edge abutting at a steep angle against the retard roller 13.

Returning to FIG. 1, the return lever 14 is provided so as to be pivotable about a pivotal shaft 14*a* in such a way that a rotation range (a pivoting range) of the return lever 14 includes the nip point between the feeding roller 12 and the retard roller 13 as seen from the side of the paper P feeding path. In a feeding standby condition, the return lever 14 is placed in a position in which it rises upstream (it closes the feeding path: a position shown by the solid line in FIG. 1). When a feeding operation starts (a rotation of the feeding roller 12 starts), the return lever 14 then falls downstream (is placed in a position shown by the phantom line in the figure) and opens the feeding path. Then, when the feeding operation is finished (the rotation of the feeding roller 12 is finished), the return lever 14 rises upstream, thereby returning the next or subsequent sheet of paper P, which stays at the nip point between the feeding roller 12 and the retard roller 13, to the hopper 11.

A configuration is such that, as shown in FIG. 8, such a series of feeding operations in the feeding device 2 is carried out by causing the hopper 11 and the return lever 14 to operate in collaboration in response to each phase (rotation angle) of the feeding roller 12 during one revolution. That is, the hopper 11 and the return lever 14 are configured to operate in collaboration with the feeding roller 12 via a not-shown cam mechanism, and are configured to form an operation pattern shown in FIG. 8 along with a rotating operation of the feeding roller 12. In FIG. 8, the rotation angle of the feeding roller 12 shows a clockwise rotation angle in FIG. 1, the rotation angle of the hopper 11 shows a clockwise rotation angle in FIG. 1, and a forward rotation angle of the return lever 14 shows a counterclockwise rotation angle in FIG. 1.

The feeding roller 12 and the transport driving roller 30 are configured to be rotationally driven by a common drive motor, in which the transport driving roller 30 is configured to be constantly rotationally driven along with a rotation of the drive motor, and the feeding roller 12 is configured to be selectively driven by not-shown power transmission switch device only during a paper feeding. At this point, when a power is being transmitted to the feeding roller 12, as described heretofore, the hopper 11 and the return lever 14 are also driven via the not-shown cam mechanism along with the rotation of the feeding roller 12. Therefore, in this condition, when a recording operation is executed while the paper P is being transported by the transport driving roller 30, the drive motor is subjected to a large load, thereby reducing accuracy during the paper transport by the transport driving roller 30, thus possibly reducing a recording quality.

At this point, the printer 1 is configured not to execute the recording operation in a condition in which a power is being transmitted to the feeding roller 12 from the drive motor. A specific configuration is as follows. That is, because the leading edge of the paper P reaches a position facing the recording head 36 during a one-revolution operation of the feeding roller 12, a recording is directly executable but, as the feeding roller 12 is in the one-revolution operation, the paper leading edge is transported further downstream and, after the one-revolution operation of the feeding roller 12 is finished, the transport driving roller 30 is rotated in reverse, thereby projecting the paper leading edge (positioning the paper leading edge).

To continue, a detailed description will be given of depressions 10*d* formed on the guide surfaces 10*b*. As shown in FIGS. 3 and 4, the guide surfaces 10*b* and 10*c* are formed by the top faces of a plurality of ribs provided at appropriately spaced intervals in the paper width direction. The ribs are also disposed in a plurality of positions adjacent to the return lever 14, between the plurality of positions, and in other positions. That is, the plurality of ribs, being provided at appropriately spaced intervals along the paper width direction, guides the paper P leading edge to the downstream side.

Of the plurality of ribs provided in the paper width direction in this way, the ribs forming the guide surfaces shown by reference numeral 10*b* are formed with the depressions 10*d*. As shown in FIG. 5, the depressions 10*d* are provided downstream of the nip point between the feeding roller 12 and the retard roller 13, and are positioned within the rotation range of the return lever 14 as seen from the side of the paper P feeding path (the details will be described hereafter).

The leading edge of the paper P to be fed is led out from the top of the hopper 11 by a rise of the hopper 11 and a rotation of the feeding roller 12, and advances downstream while being brought in contact with (being guided by) the guide surfaces 10*b* and 10*c*.

At this point, when a friction coefficient between the uppermost sheet of paper P and the feeding roller 12 is indicated by $\mu 1$, a friction coefficient between the next sheet of paper P and the retard roller 13 is indicated by $\mu 2$, and a friction coefficient between the sheets is indicated by $\mu 3$, a configuration is such that a relationship $\mu 1 > \mu 2 > \mu 3$ is established. Consequently, because of such a friction coefficient relationship, it follows that, although the next or subsequent sheet of paper P is led out from the top of the hopper 11 along with the uppermost sheet of paper P being fed, at least the leading edge of the uppermost sheet of paper P advances further downstream than the leading edge of the next or subsequent sheet of paper P.

Consequently, by using such a property, as shown in FIG. 6, when the leading edge of the uppermost sheet (shown by reference numeral P1) has advanced downstream of the position of the depression 10*d*, the return lever 14 is controlled in such a way that its leading end 14*b* is positioned in the depression 10*d*. By this means, as shown in the figure, the leading edge of the next or subsequent sheet (shown by reference numeral P2) is led into the depression 10*d*, and abuts against the leading end 14*b* of the return lever 14, thereby preventing a further advance to the downstream side.

As the uppermost sheet P1 to be fed undergoes a strong feeding force from the feeding roller 12, even though the leading edge of the uppermost sheet P1 abuts against the leading end 14*b* of the return lever 14 due to a late feeding start, it can cross over the leading end 14*b* of the return lever 14 and advance downstream. However, as the next sheet P2 undergoes no strong feeding force from the feeding roller 12 unlike the uppermost sheet P1, when the leading edge of the next sheet P2 abuts against the leading end 14*b* of the return lever 14, as shown in the figure, it stays at the position, thus preventing an advance to the downstream side.

In this embodiment, a more specific operation of the return lever 14 is as follows. That is, the return lever 14 rises slightly upstream (a portion shown by reference character Q in FIG. 8) immediately after the rotation of the feeding roller 12 is started, and thereafter falls considerably downstream (a portion shown by reference character R in FIG. 8) as shown by the phantom line in FIG. 1 so as not to prevent a feeding of the uppermost sheet P1. Then, in this embodiment, when the leading edge of the uppermost sheet P1 has advanced downstream of point A in FIG. 1, the leading end 14*b* of the return lever 14 is caused to project from the guide surface 10*b*. A timing at which the leading end 14*b* of the return lever 14 projects from the guide surface 10*b* is, in this embodiment, the time the rotation angle of the feeding roller 12 is about 154.6 (degrees). Also, in a region in which the rotation angle of the return lever 14 is smaller than about 43.7 (degrees), the leading end 14*b* of the return lever 14 projects upward from the guide surface 10*b*.

Then, the return lever 14 is controlled to be placed in a condition in which its leading end 14*b* is positioned in the depression 10*d* immediately before the feeding of the uppermost sheet P1 is finished (a linear portion shown by reference character S in FIG. 8: the rotation angle of the return lever 14 at this time is about 38.6 (degrees)). Then, when the rotation angle of the feeding roller 12 becomes about 330 (degrees), the return lever 14 rises upstream and returns to a position shown by the solid line in FIG. 1 (a linear portion shown by reference character T in FIG. 8). That is, the next or subsequent sheet P2 is returned to the top of the hopper 11.

A timing of causing the leading end 14*b* of the return lever 14 to project from the guide surface 10*b* is preferably a timing after a sufficient time has elapsed so that the leading edge of the uppermost sheet P1 is not caught by the return lever 14. However, the position of the leading edge of the uppermost sheet P1 with respect to the rotation angle of the feeding roller 12 varies depending on the number of sheets set and the amount of slip with respect to the feeding roller 12.

In this embodiment, when the leading end 14*b* of the return lever 14 projects from the guide surface 10*b*, the leading edge of the uppermost sheet P1 exists approximately between point A and point B in FIG. 1.

As described heretofore, even in the event that the next sheet P2 has advanced downstream of the nip point between the feeding roller 12 and the retard roller 13, as the next sheet P2 is stopped from advancing further downstream by the return lever 14, it is possible to more reliably prevent a multiple feeding of sheets.

Also, because the-retard roller 13, being provided in a condition in which it is urged by a not-shown urging spring toward the feeding roller 12 and the prescribed rotational resistance (torque) is applied to it, prevents a non-feeding while preventing a multiple feeding of sheets, an urging force of the urging spring and the rotational resistance need to be adjusted to an appropriate range. However, even in the event that the next or subsequent sheet has advanced downstream of the nip point between the feeding roller 12 and the retard roller 13, the leading edge of the next or subsequent sheet is stopped from advancing further downstream by the leading end 14*b* of the return lever 14. Therefore, the tolerance of the urging force of the urging spring, which urges the retard roller 13, and the rotational resistance is increased, thereby enabling a simplification of an assembly operation and a reduction in the cost of parts.

In this embodiment, a configuration is such that, while the depressions 10*d* are formed and the leading edge of the next or subsequent sheet P2 is led into the depressions 10*d*, an advance of the next or subsequent sheet P2 is stopped by the leading end 14*d* of the return lever 14. However, even in a case in which no depressions 10*d* are provided, by causing the leading end 14*d* of the return lever 14 to project from the guide surfaces 10*b* and 10*c*, it is also possible to stop an advance of the next or subsequent sheet P2.

However, by forming the depressions 10*d*, the leading end 14*d* of the return lever 14 can be caused to more reliably stop the next or subsequent sheet P2 from advancing downstream. Also, an advance of the next or subsequent sheet P2 can be stopped without causing the leading end 14*d* of the return lever 14 to project greatly with respect to the uppermost sheet P1 feeding path. Therefore, even though a timing of a passage of the uppermost sheet P1 is delayed, it is possible to feed the uppermost sheet P1 with a minimum of impediment to the feeding of the uppermost sheet P1.

Also, in this embodiment, a configuration is such that, when the leading end 14*b* of the return lever 14 is positioned in the depression 10*d*, as shown in FIG. 6, an abutment angle at which the leading edge of the sheet P2 abuts against the leading end 14*b* of the return lever 14 becomes a substantial right angle. Therefore, when the leading edge of the sheet P2, which is about to be multiply fed along with the uppermost sheet, has abutted against the return lever 14, the leading edge of the sheet P2 can be more reliably prevented from advancing downstream.

Furthermore, in this embodiment, as shown in FIG. 3, the ribs, which are provided in the positions adjacent to the return lever 14, are formed with the depressions 10*d*. Therefore, in a position close to the depressions 10*d*, the sheet leading edge can be stopped by the return lever 14. Consequently, it is possible to still more reliably prevent an advance of the leading edge of the next or subsequent sheet.

The depression 10*d* can also be formed in a shape shown by reference character 10*g* in FIG. 7 as another embodiment. The depression 10*g* has a shape which catches the leading edge of the next or subsequent sheet P2. For example, the depression 10*g* is a step having a wall portion that stands so as to be substantially perpendicular to the feeding path. By taking such a shape, it becomes possible to prevent an advance of the next or subsequent sheet P2 without disposing the return lever 14 at the position of the depression. As described heretofore, as the uppermost sheet P1 to be fed undergoes a strong feeding force from the feeding roller 12, it can cross over the depression 10*g* and advance downstream. However, as the next or subsequent sheet P2 undergoes no strong feeding force from the feeding roller 12 unlike the uppermost sheet P1, when its leading edge is caught by the depression 10*g*, it stays at the position and is thus prevented from advancing downstream.

What is claimed is:

1. A feeding device comprising:

a hopper, adapted to support a medium;

a feeder, operable to feed the medium in a first direction;

a separator, operable to nip the medium with the feeder at a nip point;

a guide, having a guide surface which guides the medium in the first direction and is provided with a recessed portion at a downstream side of the nip point in the first direction; and at least two levers, operable to pivot in a pivoting area that includes a point corresponding to the nip point in a second direction perpendicular to the first direction, and arranged in the second direction, wherein the guide provided with the recessed portion is disposed between the levers, and the levers are controlled so that end portions of the levers are positioned so as to correspond to the recessed portion in the second direction after a leading end of the medium has passed through the nip point, and the guide surface includes top surfaces of a plurality of ribs which are arranged in the second direction with a prescribed interval, and at least one of the ribs which is adjacent to the levers is provided with the recessed portion.

2. The feeding device according to claim 1, wherein the medium includes a first medium and a second medium that is to be fed next to the first medium, and the end portions of the levers are positioned so as to correspond to the recessed portion in the second direction after a leading end of the first medium has passed through the nip point so that the levers prevent the second medium from being fed.

3. The feeding device according to claim 1, wherein in a case the end portions of the levers are positioned so as to correspond to the recessed portion in the second direction, an angle between the leading end of the medium and each of the levers is a substantially right angle.

4. The feeding device according to claim 1, wherein the recessed portion includes a wall portion substantially perpendicular to the first direction.

5. The feeding device according to claim 1, wherein the separator includes a roller which is urged toward the feeder and to which a prescribed rotational resistance is applied.

6. A recording apparatus incorporating the feeding device according to claim 1, comprising:

a recording device, disposed in the downstream section and operable to record information on the medium fed by the feeding device.

7. A liquid ejecting apparatus incorporating the feeding device according to claim 1, comprising:

a liquid ejecting device, disposed in the downstream section and operable to eject liquid toward the medium fed by the feeding device.

8. The feeding device according to claim 1, wherein the medium includes a first medium and a second medium that is to be fed next to the first medium, and until the feeding of the first medium is finished, the levers are stopped in a condition that the levers are positioned so as to correspond to the recessed portion in the second direction.

9. The feeding device according to claim 8, wherein a rotation angle of each of the levers is maintained constant, so that the levers are stopped.

10. The feeding device according to claim 9, wherein the second medium is abutted against the levers.

* * * * *